US008229309B2

(12) United States Patent
Ono et al.

(10) Patent No.: US 8,229,309 B2
(45) Date of Patent: Jul. 24, 2012

(54) IMAGE FORMING DEVICE, COMPUTER READABLE MEDIUM AND PHOTORECEPTOR DETERIORATION CONDITION ESTIMATION METHOD

(75) Inventors: Tomohiro Ono, Kanagawa (JP); Shinya Makiura, Kanagawa (JP); Tomokazu Kurita, Niigata (JP); Hiroki Ando, Kanagawa (JP); Toshie Nakamoto, Kanagawa (JP); Hideki Moriya, Kanagawa (JP); Masao Ohmori, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 381 days.

(21) Appl. No.: 12/560,473

(22) Filed: Sep. 16, 2009

(65) Prior Publication Data

US 2010/0215385 A1 Aug. 26, 2010

(30) Foreign Application Priority Data

Feb. 23, 2009 (JP) ..... 2009-039674

(51) Int. Cl.
*G03G 15/02* (2006.01)

(52) U.S. Cl. ..... 399/50; 399/26; 399/176

(58) Field of Classification Search ..... 399/9, 24, 399/26, 31, 38, 50, 75, 116, 159, 168, 174, 399/176

See application file for complete search history.

(56) References Cited

U.S. PATENT DOCUMENTS 5,457,522 A * 10/1995 Haneda et al. ..... 399/176
5,485,248 A * 1/1996 Yano et al. ..... 399/73

FOREIGN PATENT DOCUMENTS

| | | | |
|---|---|---|---|
| JP | 2000-206765 | A | 7/2000 |
| JP | 2002-072778 | A | 3/2002 |
| JP | 2002-207351 | A | 7/2002 |
| JP | 2002-365984 | A | 12/2002 |
| JP | 2005-017512 | A | 1/2005 |
| JP | 2006-276054 | A | 10/2006 |

* cited by examiner

*Primary Examiner* — David Porta
*Assistant Examiner* — Benjamin Schmitt
(74) *Attorney, Agent, or Firm* — Sughrue Mion, PLLC

(57) ABSTRACT

An image forming device includes an image holding member and a charging unit. In a case in which an AC current, while being increased, is supplied to the charging unit in a state in which a DC voltage value and an AC voltage value applied to the charging unit are maintained, or a case in which a DC voltage, while being increased, is supplied to the charging unit in a state in which the AC voltage value applied to the charging unit is maintained, a current detection unit detects DC current values. An inflection point derivation unit derives an inflection point of a correlation line representing an correlation between the detected DC current values and the supply amounts. An execution unit executes pre-specified processing when a characteristic value of the derived inflection point reaches a pre-specified value.

16 Claims, 5 Drawing Sheets

IMAGE FORMING DEVICE, COMPUTER READABLE MEDIUM AND PHOTORECEPTOR DETERIORATION CONDITION ESTIMATION METHOD

CROSS-REFERENCE TO RELATED APPLICATION

This application is based on and claims priority under 35 USC 119 from Japanese Patent Application No. 2009-039674 filed Feb. 23, 2009.

BACKGROUND

1. Technical Field

The present invention relates to an image forming device, a computer readable medium and a photoreceptor deterioration condition estimation method.

2. Related Art

An image forming device has been provided that includes: a photoreceptor that is driven to rotate; a charging member that is disposed touching or close to the photoreceptor and charges up the photoreceptor; a DC current detector that detects a DC current amount flowing from the charging member into the photoreceptor; and a controller that applies DC voltage and AC voltage, in a range in which DC current flows into the photoreceptor, to the charging member under plural conditions and, on the basis of variations in current amounts of the DC current, determines an AC voltage to be applied to the charging member.

SUMMARY

According to an aspect of the invention, there is provided an image forming device including: an image holding member provided with a photoreceptor at a surface thereof, the image holding member holding an electrostatic image that is formed at the surface by light being illuminated in accordance with image information in a charged state; a charging unit that charges the surface of the image holding member by applying a voltage in which a DC voltage and an AC voltage are superimposed; a current detection unit that, in one of a case in which an AC current, while being increased, is supplied to the charging unit in a state in which the DC voltage value and AC voltage value applied to the charging unit are maintained, or a case in which a DC voltage, while being increased, is supplied to the charging unit in a state in which the AC voltage value applied to the charging unit is maintained, detects DC current values that flow to the image holding member in association with supply amount increases; an inflection point derivation unit that derives an inflection point of a correlation line representing a correlation between the DC current values that are detected by the current detection unit and the supply amounts that are supplied to the image holding member at times of detection of these DC current values; and an execution unit that executes pre-specified processing when a characteristic value of the inflection point derived by the inflection point derivation unit reaches a pre-specified value.

BRIEF DESCRIPTION OF THE DRAWINGS

Exemplary embodiments of the present invention will be described in detail based on the following figures, wherein.

DETAILED DESCRIPTION

Herebelow, the best embodiment for carrying out the present invention will be described in detail with reference to the drawings.

Figure 1:
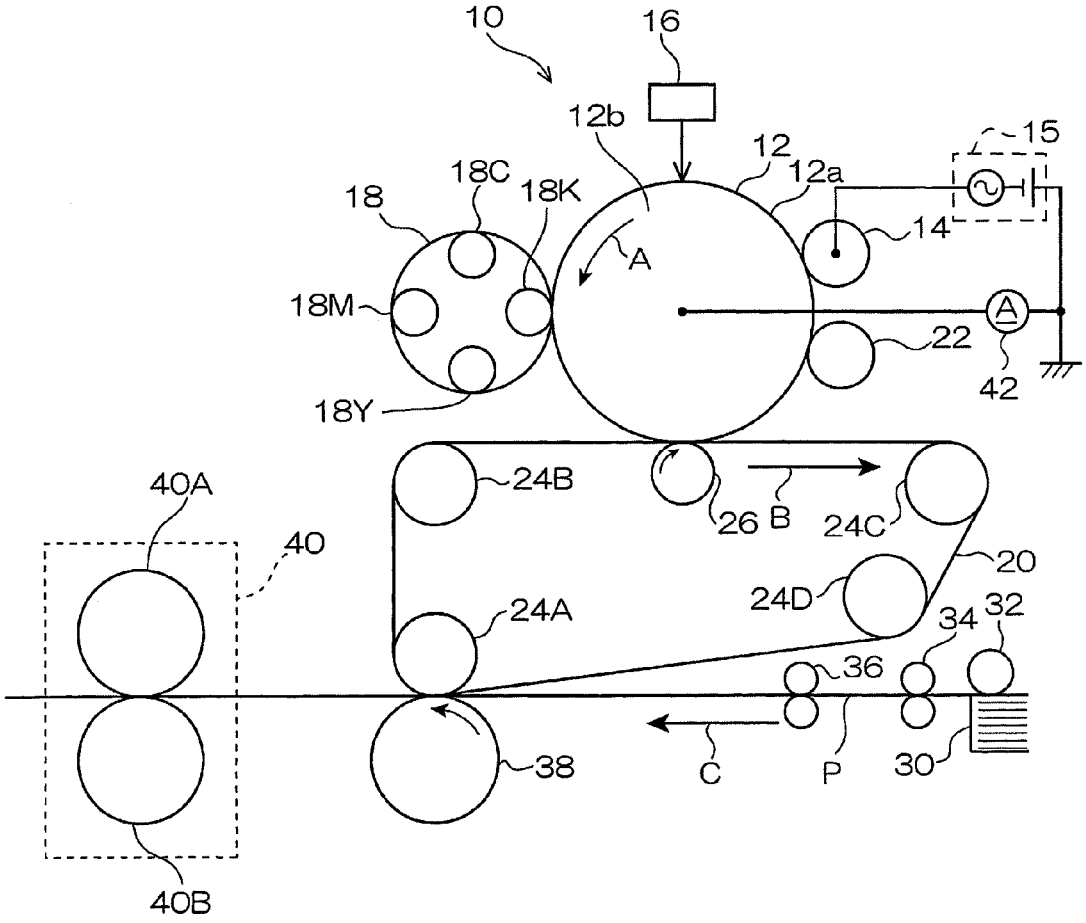
FIG. 1 is a schematic side view illustrating principal structures of an image forming device relating to an exemplary embodiment.

FIG. 1 is a schematic side view illustrating principal structures of an image forming device 10 relating to a present exemplary embodiment. As shown in FIG. 1, the image forming device 10 is provided with a photoreceptor drum 12 that is turned by a motor (not shown) in the direction of curved arrow A, which is the sub-scanning direction, at a pre-specified rotation speed. The photoreceptor drum 12 is provided with a photosensitive film 12*a* and a support 12*b*. The photosensitive film 12*a* is provided at an outer peripheral face of the photoreceptor drum 12 and is formed with an electron transport layer and a charge generation layer. The support 12*b* is constituted of aluminum or the like, which supports the photosensitive film 12*a*.

At the outer peripheral face of the photoreceptor drum 12, a charging roller 14 that charges up the outer peripheral face of the photoreceptor drum 12 is provided touching thereagainst. In the image forming device 10 relating to the present exemplary embodiment, the charging roller 14 that is employed is a contact-type charger, but this is not to be limiting; a non-contact type charger such as a scorotron charger, a corotron charger or the like may be used.

The charging roller 14 is a conductive roller, and is turnable so as to follow rotation of the photoreceptor drum 12. A voltage in which an AC voltage and a DC voltage are superimposed (hereinafter referred to as a superimposed voltage) is applied from a charging power supply 15 to the charging roller 14. Hence, the charging roller 14 uniformly charges the outer peripheral face of the photoreceptor drum 12 to a pre-specified potential. In the present exemplary embodiment, the superimposed voltage applied to the charging roller 14 is negative, and therefore the outer peripheral face of the photoreceptor drum 12 is negatively charged by the charging roller 14.

A laser beam scanning device 16 is disposed at a downstream side relative to the charging roller 14 in the curved arrow A direction of the photoreceptor drum 12. The laser beam scanning device 16 modulates a laser beam emitted from a light source in accordance with an image that is to be formed, deflects the laser beam in the main scanning direction, and scans the laser beam over the outer peripheral face of the photoreceptor drum 12 in parallel with the axis of the photoreceptor drum 12. Thus, an electrostatic latent image is formed on the outer peripheral face of the photoreceptor drum 12.

A developing device 18 is disposed at the downstream side relative to the laser beam scanning device 16 in the curved arrow A direction of the photoreceptor drum 12. The developing device 18 is provided with a turnably disposed roller-form housing. Inside the housing, four housing portions corresponding to the colors yellow (Y), magenta (M), cyan (C) and black (K) are formed. Developers 18Y, 18M, 18C and 18K are respectively provided with developing rollers (not shown) and store toners of the colors Y, M, C and K thereinside. A charge removal and cleaning apparatus 22 is disposed at an opposite side of the photoreceptor drum 12 from the developing device 18, sandwiching the photoreceptor drum 12. The charge removal and cleaning apparatus 22 is equipped with a function of de-charging the outer peripheral face of the photoreceptor drum 12 and a function of cleaning unneeded toner that is left on the outer peripheral face.

Formation of a color image by the image forming device 10 relating to the present exemplary embodiment is carried out over four rotations by the photoreceptor drum 12. That is, while the photoreceptor drum 12 turns four times, the charging roller 14 continues charging of the outer peripheral face of the photoreceptor drum 12 and the charge removal and cleaning apparatus 22 continues de-charging of the outer peripheral face, and the laser beam scanning device 16 repeatedly scans over the outer peripheral face of the photoreceptor drum 12 with a laser beam modulated in accordance with one of the Y, M, C and K color information that represent the color image that is to be formed, switching between the color information to be used in modulation of the laser beam once at each rotation by the photoreceptor drum 12. The developing device 18 moves the developers to correspond with the outer peripheral face in states in which the developing roller of one of the developers 18Y, 18M, 18C and 18K corresponds with the outer peripheral face of the photoreceptor drum 12. Thus, the electrostatic latent images formed at the outer peripheral face of the photoreceptor drum 12 are developed with the particular colors, and the formation of toner images of the particular colors on the outer peripheral face of the photoreceptor drum 12 is repeated with the housing being turned so as to exchange the developer that is used in development of the electrostatic latent image once at each rotation by the photoreceptor drum 12.

Thus, at respective rotations by the photoreceptor drum 12, the toner images of Y, M, C and K are successively formed to be overlaid on another on the outer peripheral face of the photoreceptor drum 12. Thus, a full color toner image will be formed on the outer peripheral face of the photoreceptor drum 12 when the photoreceptor drum 12 has turned four times.

An endless intermediate transfer belt 20 is provided substantially below the photoreceptor drum 12. The intermediate transfer belt 20 is wound round rollers 24A to 24D, and is disposed such that an outer peripheral face thereof touches against the outer peripheral face of the photoreceptor drum 12. Driving force from a motor (not shown) is propagated to and turns the rollers 24A to 24D, and the intermediate transfer belt 20 is turned in the direction of arrow B.

A first transfer roller 26 is disposed sandwiching the intermediate transfer belt 20 at an opposite side thereof from the photoreceptor drum 12. The intermediate transfer belt 20 is pressed against the outer peripheral face of the photoreceptor drum 12 by the first transfer roller 26. A transfer power supply (not shown) is provided in the image forming device 10, which provides electricity to the first transfer roller 26 in order to transfer a toner image on the photoreceptor drum 12 onto the first transfer roller 26.

Thus, by electric power being provided to the first transfer roller 26 by the transfer power supply and the intermediate transfer belt 20 being pressed against the outer peripheral face of the photoreceptor drum 12 by the first transfer roller 26, a toner image formed on the outer peripheral face of the photoreceptor drum 12 is transferred to an image formation surface of the intermediate transfer belt 20. When a toner image formed on the outer peripheral face of the photoreceptor drum 12 is transferred onto the image formation surface of the intermediate transfer belt 20, the region of the outer peripheral face of the photoreceptor drum 12 that carried the transferred toner image is cleaned by the charge removal and cleaning apparatus 22.

A paper holder 30 is disposed at a lower side relative to the intermediate transfer belt 20. Numerous sheets of paper P, which serves as a recording medium, are accommodated in the paper holder 30 in a stacked state. A take-out roller 32 is disposed diagonally upward to the left of the paper holder 30 in FIG. 1. Roller pairs 34 and 36 are disposed in this order at the downstream side in a direction of drawing-out of the paper P by the take-out roller 32. The paper P that is disposed uppermost in the stacked state is drawn out from the paper holder 30, by the take-out roller 32 turning, and is conveyed by the roller pairs 34 and 36.

A second transfer roller 38 is disposed to sandwich the intermediate transfer belt 20 at the opposite side thereof from the roller 24A. The intermediate transfer belt 20 is pressed against an outer peripheral face of the roller 24A by the second transfer roller 38. The paper P that has been conveyed by the roller pairs 34 and 36 is fed in between the intermediate transfer belt 20 and the second transfer roller 38, and a toner image that has been formed on the image formation surface of the intermediate transfer belt 20 is transferred by the second transfer roller 38. Similarly to the first transfer roller 26, electricity for the transfer is provided to the second transfer roller 38.

Relative to the second transfer roller 38, a fixing apparatus 40 is disposed at the downstream side in the conveyance direction of the paper P (the direction of arrow C in FIG. 1). The fixing apparatus 40 is equipped with a heating roller 40A, which heats the toner image on the paper P, and a roller 40B, which presses against the heating roller 40A. When the paper P passes through a nipping portion between the heating roller 40A and the roller 40B, the toner image is fused and solidified, and fixed to the paper P. The paper P is ejected out of the image forming device 10 by ejection rollers (not shown) which are disposed at the downstream side in the paper P conveyance direction relative to the fixing apparatus 40.

In the image forming device 10, a current detector 42 is provided, which detects a value (hereinafter referred to as a DC current value) of a DC current component that flows into the photoreceptor drum 12 from the charging roller 14.

Figure 2:
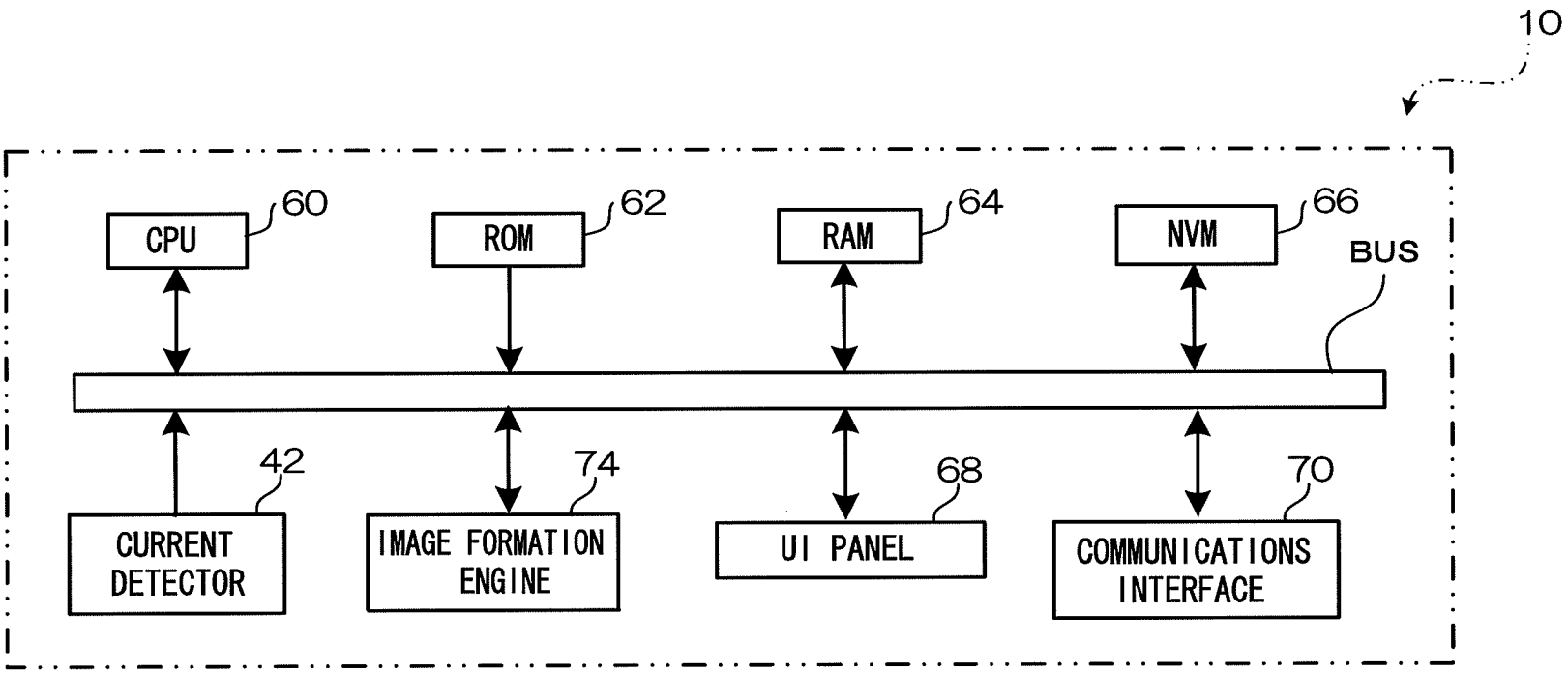
FIG. 2 is a block diagram illustrating principal structures of an electronic system of the image forming device relating to the exemplary embodiment.

FIG. 2 is a block diagram illustrating principal structures of an electronic system of the image forming device 10 relating to the present exemplary embodiment. As shown in FIG. 2, the image forming device 10 is constituted to include a CPU (central processing unit) 60, a ROM (read-only memory) 62, a RAM (a random access memory) 64, an NVM (non-volatile memory) 66, a UI (user interface) panel 68 and a communications interface 70.

The CPU 60 administers operations of the image forming device 10 as a whole. The ROM 62 functions as a memory at which a control program that controls operations of the image forming device 10, a later-described deterioration condition estimation processing program, and various parameters and the like are pre-memorized. The RAM 64 is used as a work area during execution of the various programs, and the like. The NVM 66 memorizes various kinds of information that need to be held when a power switch of the device is turned off.

The UI panel 68 is constituted with a touch panel display in which a transparent touch panel is superimposed on a display, or the like. The UI panel 68 displays various kinds of information at a display screen of the display, and inputs required information, instructions and the like in accordance with a user touching the touch panel.

The communications interface 70 is connected to a terminal device such as a personal computer or the like (not shown), and receives various kinds of information from the terminal device, such as image information representing an image that is to be formed on the paper P and the like.

The CPU 60, the ROM 62, the RAM 64, the NVM 66, the UT panel 68 and the communications interface 70 are connected to one another through a system bus. Therefore, the CPU 60 may implement each of access to the ROM 62, the RAM 64 and the NVM 66, display of various kinds of information at the UI panel 68, acquisition of details of control instructions from users from the UI panel 68, reception of various kinds of information from the terminal device via the communications interface 70, and transmission of various kinds of information to the terminal device via the communications interface 70.

The image forming device 10 is constituted to include an image formation engine 74 that carries out image formation on the paper P by a xerography system. The image formation engine 74 is constituted to include the above-mentioned photoreceptor drum 12, charging roller 14, charging power supply 15, laser beam scanning device 16, developing device 18, charge removal and cleaning apparatus 22, rollers 24A to 24D, first transfer roller 26, transfer power supply, roller pairs 34 and 36, second transfer roller 38 and fixing apparatus 40, and a motor (not shown) that drives the respective rollers.

The current detector 42 and the image formation engine 74 are also connected to the system bus. Thus, the CPU 60 implements each of acquisition of the DC current value detected by the current detector 42 and control of operations of the image formation engine 74.

Operations of the image forming device 10 relating to the present exemplary embodiment will be described.

A flow of processing of the image formation engine 74 is briefly described.

The outer peripheral face of the photoreceptor drum 12 is charged up by the charging roller 14, and when rotary driving of the photoreceptor drum 12 and the intermediate transfer belt 20 commences, an electrostatic latent image is formed on the photoreceptor drum 12 by the laser beam scanning device 16. Toner is provided to the electrostatic latent image by the developing device 18, and thus the electrostatic latent image is visualized as a toner image. This toner image is conveyed to the position of contact with the intermediate transfer belt 20 by the photoreceptor drum 12 (a first transfer position).

Electricity is supplied to the first transfer roller 26 by the transfer power supply, and the intermediate transfer belt 20 is pressed against the outer peripheral face of the photoreceptor drum 12 by the first transfer roller 26. In consequence, the toner image on the photoreceptor drum 12 is transferred to the image formation surface of the intermediate transfer belt 20. That is, the toner image is conveyed by the photoreceptor drum 12 turning in the direction of arrow A in FIG. 1 and is transferred to the outer peripheral face of the intermediate transfer belt 20. The toner image, which is conveyed in the direction of arrow B by the intermediate transfer belt 20, is transferred to the paper P at the position of contact with the second transfer roller 38 (a second transfer position), and is fixed by the fixing apparatus 40.

As the photoreceptor drum 12 is used, the photosensitive film 12*a* is progressively reduced by abrasion and the photoreceptor drum 12 progressively deteriorates over time. Heretofore, for example, when a total number of rotations of the photoreceptor drum 12 reached a pre-specified number of rotations or when a number of cycles of image formation reached a pre-specified number, this has been treated as a replacement time of the photoreceptor drum 12, and information prompting replacement of the photoreceptor drum 12 has been provided to a user.

However, environments in which the image forming device 10 is disposed and usage conditions and the like vary, and it cannot necessarily be said that the photoreceptor drum 12 has reached a replacement time when the total number of rotations of the photoreceptor drum 12 has reached a pre-specified number of rotations or the number of image formation cycles has reached a pre-specified number. Furthermore, while it is usual to set the replacement time with some tolerance relative to the lifespan of the photoreceptor drum 12, there are users who would wish to replace the photoreceptor drum 12 when the photoreceptor drum 12 has reached its lifespan.

In the image forming device 10 relating to the present exemplary embodiment, when a pre-specified condition is satisfied (in the present exemplary embodiment, when a total number of rotations of the photoreceptor drum 12 from a time at which the photoreceptor drum 12 first rotated reaches a predetermined number (herein, 50 million rotations, 100 million rotations, 500 million rotations, 1 billion rotations, 5 billion rotations or 10 billion rotations)), usual image formation processing is interrupted and deterioration condition estimation processing is executed, which precisely estimates a deterioration condition of the photoreceptor drum 12, and then executes processing in accordance with the deterioration condition.

Figure 3:
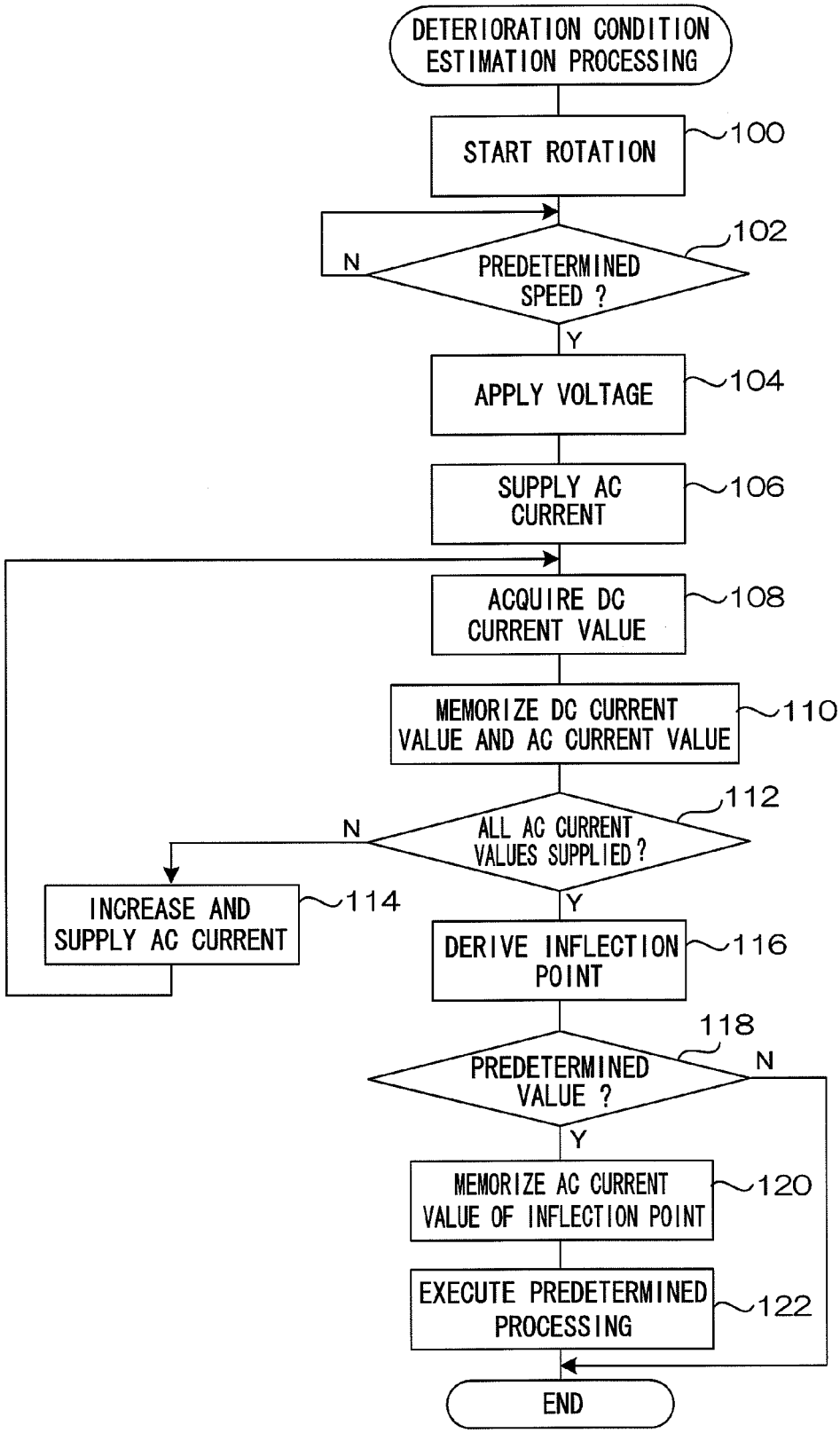
FIG. 3 is a flowchart illustrating a flow of processing of a deterioration condition estimation processing program relating to the exemplary embodiment.

Operation of the image forming device 10 when the deterioration condition estimation processing is being executed will be described with reference to FIG. 3. FIG. 3 is a flowchart illustrating a flow of processing of the deterioration condition estimation processing program that is executed by the CPU 60 of the image forming device 10 at this time. This program is pre-memorized in a pre-specified region of the ROM 62.

In step 100, rotation of the photoreceptor drum 12 begins, after which the processing advances to step 102 and waits until the photoreceptor drum 12 reaches a pre-specified number of rotations.

In step 104, a superimposed voltage of specified magnitude is applied to the charging roller 14, and the charging power supply 15 is controlled so as to maintain the superimposed voltage values. As a result, the outer peripheral face of the photoreceptor drum 12 is charged up.

In step 106, the charging power supply 15 is controlled so as to supply to the charging roller 14 a smallest AC current value of plural pre-specified AC current values with respectively different magnitudes. The processing advances to step 108, a DC current value detected by the current detector 42 is acquired, and the processing advances to step 110.

In step 110, the AC current value supplied to the charging roller 14 and the DC current value acquired in step 108 are memorized in association in the NVM 66, after which the processing advances to step 112. In step 112, it is determined whether or not all AC current values of the above-mentioned plural pre-specified AC current values have been supplied to the charging roller 14. If this determination is negative, the processing advances to step 114, and the charging power supply 15 is controlled so as to supply to the charging roller 14 the AC current value, of the plural pre-specified AC current values, that is next largest from the previously supplied AC current value.

If the determination in step 112 is positive, the processing advances to step 116, and an inflection point of a correlation line representing a correlation between the AC current values and DC current values memorized in the NVM 66 by the processings of step 110 is derived, after which the processing advances to step 118. In step 118, it is determined whether or not a characteristic value of the inflection point derived in step 116 reaches a pre-specified value (herein, a value obtained beforehand by experimentation with actual models of the image forming device 10 in which the photoreceptor drum 12 has reached its lifespan, computer simulation based on design specifications of the image forming device 10, and the like). If this determination is positive, the processing advances to step 120. If the determination is negative, the present deterioration condition estimation processing program ends without executing the processing of step 120 and step 122. This inflection point represents a point at which the potential of the photoreceptor drum 12 is saturated.

In step 120, the AC current value of the inflection point derived in step 116 is memorized in the NVM 66. If an AC current value of an inflection point has previously been memorized in the NVM 66, this AC current value is updated by overwriting. The AC current value memorized in the NVM 66 by the processing of step 120 will be used when the present deterioration condition estimation processing program is next executed. That is, when this deterioration condition estimation processing program is next executed, in step 106, control is performed such that rather than the minimum AC current value of the pre-specified AC current values being supplied to the charging roller 14, the charging roller 14 is supplied with, for example, an AC current value between the AC current value memorized in the NVM 66 by the processing of step 120 and the above-mentioned minimum AC current value. Thus, a number of cycles of derivation of the inflection point is restrained. That is, a number of cycles of execution of the deterioration condition estimation processing is restrained.

In step 122, information indicating that the photoreceptor drum 12 is at its lifespan is displayed at the UI panel 68, after which the present deterioration condition estimation processing program ends.

In the image forming device 10 relating to the present exemplary embodiment, a visible display of information indicating that the photoreceptor drum 12 is at its lifespan is implemented, but this is not to be limiting. An audible indication using a sound reproduction device such as a speaker or the like may be implemented, or a permanent visible display may be implemented by printing. The visible display, audible indication and permanent visible display may be plurally combined.

In the image forming device 10 relating to the present exemplary embodiment, a gradient of a tangent at the inflection point is employed as the characteristic value, but this is not to be limiting. An interception value of a linear function representing the tangent at the inflection point, the AC current value at the inflection point, the DC current value at the inflection point or the like may be employed. Any value may be used provided the value represents a characteristic of the inflection point.

Figure 4:
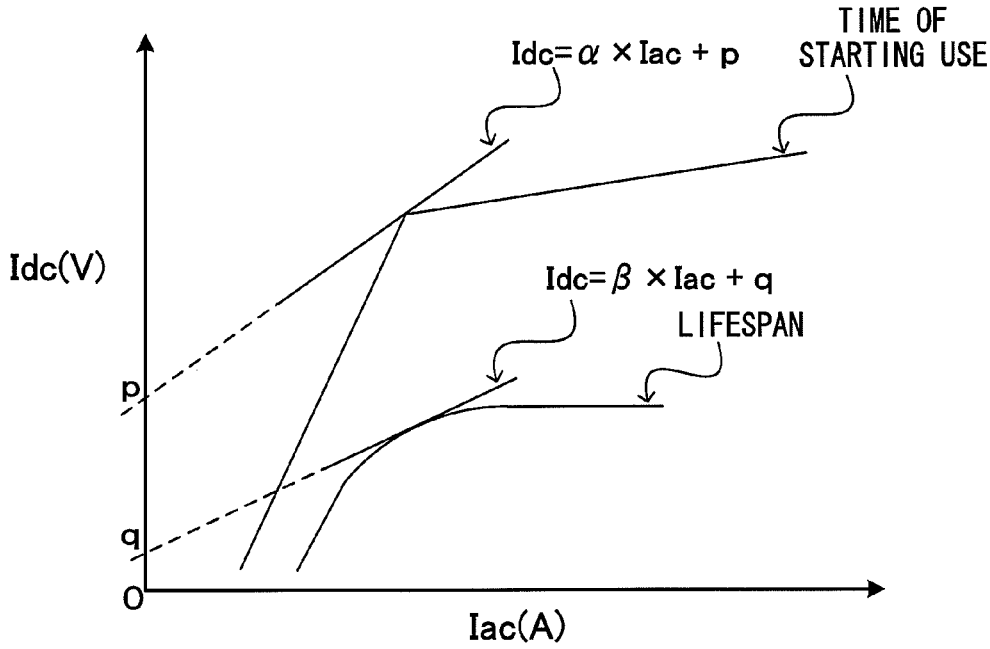
FIG. 4 is a graph illustrating a correlation between AC current values that are supplied to a charger of the image forming device relating to the exemplary embodiment and DC current values that flow to a photoreceptor drum.
Figure 5:
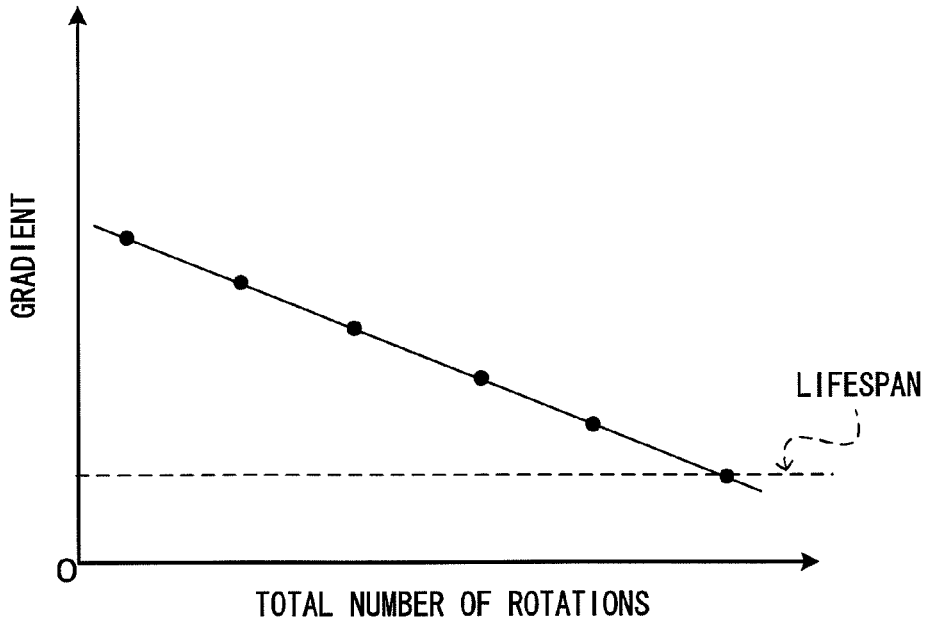
FIG. 5 is a graph illustrating a correlation between total numbers of rotations of the photoreceptor drum and gradients of tangents at inflection points of curves representing correlation between AC current values that are supplied to the charger and DC current values that flow to the photoreceptor drum.

A case in which the characteristic value is the gradient of the tangent at the inflection point is illustrated as an example in FIG. 4. If the above-described deterioration condition estimation processing is executed at a time of commencement of use of the photoreceptor drum 12, a linear function representing the tangent at the inflection point of the correlation line representing the correlation between AC current values Tac and DC current values Idc that are memorized in the NVM 66 is $Idc=\alpha\times Iac+p$. If the above-described deterioration condition estimation processing is executed at a time at the lifespan of the photoreceptor drum 12, the linear function representing the tangent at the inflection point of the correlation line representing the correlation between the AC current values Tac and DC current values Idc that are memorized in the NVM 66 is $Idc=\beta\times Iac+q$. Therefore, in the image forming device 10 relating to the present exemplary embodiment, it is determined that the photoreceptor drum 12 has reached its lifespan when the gradient a of the linear function at a time of commencement of use of the photoreceptor drum 12 has gone to the gradient P. That is, in the image forming device 10 relating to the present exemplary embodiment, as shown by the example in FIG. 5, the gradient of the inflection point of the correlation line representing the correlation between the AC current values Tac and DC current values Idc that are memorized in the NVM 66 is derived by executing the above deterioration condition estimation processing each time the total number of rotations of the photoreceptor drum 12 reaches a pre-specified number of rotations, and it is determined that the lifespan has been reached when this gradient reaches a pre-specified gradient.

Hereabove, the present invention has been described using the above exemplary embodiment, but the technical scope of the present invention is not to be limited to the scope described in the above exemplary embodiment. Numerous modifications and improvements may be applied to the above exemplary embodiment within a scope not departing from the spirit of the invention, and modes to which these modifications and improvements are applied are to be encompassed by the technical scope of the present invention.

The above exemplary embodiment is not limiting to the inventions recited in the claims, and not all of the combination of characteristics described in the above exemplary embodiment are necessarily required for a resolution of the invention. Inventions with various stages of the above exemplary embodiment are to be included, and various inventions may be derived by combinations of the disclosed plurality of structural elements in accordance with circumstances. Even if some structural element is removed from the totality of structural elements illustrated in the above exemplary embodiment, as long as the effect is obtained, a structure from which this some structural element has been removed may be derived to serve as the invention.

For example, in the above exemplary embodiment, an example of a case in which AC current is applied to the charging roller 14 while being increased, in conditions in which the superimposed voltage value applied to the charging roller 14 is maintained, and DC current values that flow into the photoreceptor drum 12 in association with the increases in the supply amount are detected has been described as an example. However, the present invention is not to be limited thus. A DC voltage may be supplied to the charging roller 14 while being increased, in conditions in which, of the AC voltage value and DC voltage value applied to the charging roller 14, only the AC voltage value is fixed, and AC current values that flow into the photoreceptor drum 12 in association with the increases in the supply amounts may be detected. The same effect will be obtained in this case too.

Figure 6:
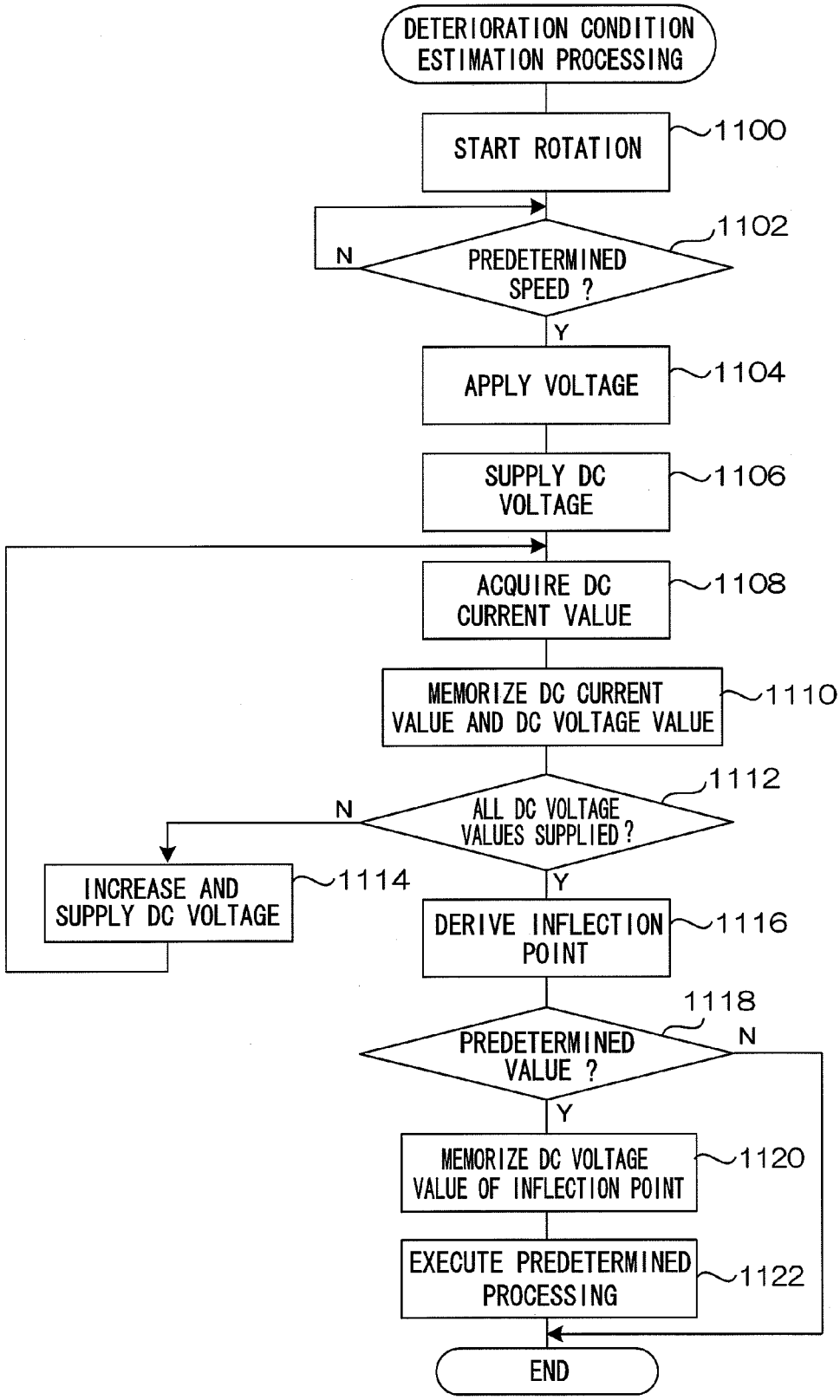
FIG. 6 is a flowchart illustrating a flow of processing of a deterioration condition estimation processing program relating to a variant embodiment.

In this case, as illustrated in FIG. 6, in the deterioration condition estimation program, the following processing is carried out. In step 1104, an AC voltage of a pre-specified magnitude is applied to the charging roller 14, and the charging power supply 15 is controlled so as to maintain the AC voltage. In step 1106, the charging power supply 15 is controlled so as to supply to the charging roller 14 a smallest DC voltage value of plural pre-specified DC voltage values with respectively different magnitudes. In step 1110, the DC voltage value provided to the charging roller 14 and an AC current value acquired in step 1108 are memorized in association in the NVM 66. In step 1112, it is determined whether or not all of the plural pre-specified DC voltage values have been supplied to the charging roller 14. In step 1114, the charging power supply 15 is controlled so as to supply to the charging roller 14 the DC voltage value, of the plural pre-specified DC voltage values, that is next largest from the previously supplied DC voltage value. In step 1116, an inflection point of a correlation line representing a correlation between the DC voltage values and AC current values that are memorized in the NVM 66 by the processing of step 110 is derived. In step 1120, the DC voltage of the inflection point is memorized in the NVM 66.

In the above exemplary embodiment, information indicating that the photoreceptor drum 12 is at its lifespan is displayed when the characteristic value of the inflection point reaches the pre-specified value, but this is not to be limiting. For example, from the next time of image formation, the AC current value when the characteristic value of the inflection point reaches the pre-specified value may be applied to the photoreceptor drum 12 as an AC current value required for forming excellent images. Further, utilizing the fact of the inflection point representing the saturation point of potential of the photoreceptor drum 12, there may be plural pre-specified values to serve as comparison objects for the characteristic value of the inflection point, and when the characteristic value of the inflection point reaches one of the plural pre-specified values, an AC current value obtained by multiplication with a coefficient corresponding to the AC current value when the characteristic value reaches that pre-specified value may be applied to the photoreceptor drum 12 at subsequent times of image formation. Further yet, when the characteristic value of the inflection point reaches the pre-specified value, information representing a film thickness of the photosensitive film 12*a* of the photoreceptor drum 12 may be displayed. In such manners, processing that is executed when the characteristic value of the inflection point reaches a pre-specified value may have all kinds of contents.

In the above exemplary embodiment, an example is described of a case in which there is a single pre-specified value serving as a comparison object for the characteristic value of the inflection point, but this is not to be limiting. There may be plural pre-specified values serving as comparison values for the characteristic value of the inflection point, different processing in response to each of the pre-specified values may be set in advance, and when the characteristic value of the inflection point reaches one of the pre-specified values, the CPU 60 may execute the processing that corresponds to that pre-specified value. In this case, a mode of processing that is executed by the CPU 60 may be, for example, a mode of step-by-step processing to display information to the effect that the photoreceptor drum 12 will reach the end of its lifespan after another XX rotations and then processing to display information to the effect that the photoreceptor drum 12 has reached the end of its lifespan (a mode of step-by-step display of deterioration conditions of the photoreceptor drum 12), a mode in which information representing the deterioration condition of the photoreceptor drum 12 is transmitted step-by-step to a host computer, or the like.

Moreover, the constitution of the image forming device 10 described in the above exemplary embodiment (see FIG. 1 and FIG. 2) is an example and obviously may be altered in accordance with circumstances within a scope not departing from the spirit.

Furthermore, the flow of processing of the deterioration condition estimation processing program described in the above exemplary embodiment (see FIG. 3) is also an example and obviously unnecessary steps may be removed, new steps may be added and the processing sequence may be rearranged within a scope not departing from the spirit.

In the above exemplary embodiment, an example is described of a case in which the deterioration condition estimation processing is realized by a software structure using a computer, by executing the deterioration condition estimation processing program, but this is not to be limiting. The deterioration condition estimation processing may be realized by a hardware structure, a combination of a hardware structure and a software structure, or the like.

What is claimed is:

1. An image forming device comprising:

an image holding member provided with a photoreceptor at a surface thereof, the image holding member holding an electrostatic image that is formed at the surface by light being illuminated in accordance with image information in a charged state;

a charging unit that charges the surface of the image holding member by applying a voltage in which a DC voltage and an AC voltage are superimposed;

a current detection unit that, in one of a case in which an AC current, while being increased, is supplied to the charging unit in a state in which the DC voltage value and AC voltage value applied to the charging unit are maintained, or a case in which a DC voltage, while being increased, is supplied to the charging unit in a state in which the AC voltage value applied to the charging unit is maintained, detects DC current values that flow to the image holding member in association with supply amount increases;

an inflection point derivation unit that derives an inflection point of a correlation line representing a correlation between the DC current values that are detected by the current detection unit and the supply amounts that are supplied to the image holding member at times of detection of these DC current values;

an execution unit that executes pre-specified processing when a characteristic value of the inflection point derived by the inflection point derivation unit reaches a pre-specified value;

a holding unit that holds supply amount data representing the supply amount when the characteristic value of the inflection point derived by the inflection point derivation unit reaches the pre-specified value; and an update unit that updates the supply amount data held by the holding unit when the characteristic value of the inflection point derived by the inflection point derivation unit reaches the pre-specified value in a state in which the supply amount data is held by the holding unit.

2. The image forming device according to claim 1 wherein, when the characteristic value of the inflection point derived by the inflection point derivation unit reaches one of a plurality of pre-specified values, the execution unit executes processing in accordance with this pre-specified value.

3. The image forming device according to claim 1, wherein the characteristic value is a gradient of a tangent at the inflection point.

4. The image forming device according to claim 1, wherein the pre-specified processing includes processing that reports a deterioration condition of the photoreceptor.

5. The image forming device according to claim 1, wherein the pre-specified processing includes processing that reports that the photoreceptor is at a lifespan thereof.

6. The image forming device according to claim 1, wherein the pre-specified processing includes processing that, at a next time of image formation, applies the voltages to the charging unit on the basis of the supply amount when the characteristic value of the inflection point derived by the inflection point derivation unit reaches the pre-specified value.

7. The image forming device according to claim 1, wherein the pre-specified processing includes processing that reports a film thickness of a photosensitive layer of the photoreceptor.

8. The image forming device according to claim 1 wherein, when a total number of rotations of the photoreceptor reaches a predetermined number of rotations, the supply amounts are supplied to the charging unit while being increased, and the current detection unit detects the DC current values that flow to the image holding member in association with the supply amount increases.

9. The image forming device according to claim 1 wherein, in the case in which an AC current, while being increased, is supplied to the charging unit in the state in which the DC voltage value and AC voltage value applied to the charging unit are maintained, the current detection unit detects the DC current values that flow to the image holding member in association with the AC current increases, and the inflection point derivation unit derives the inflection point of the correlation line representing the correlation between the DC current values that are detected by the current detection unit and the AC current values that are supplied to the image holding member at the times of detection of these DC current values.

10. The image forming device according to claim 9, wherein the holding unit holds supply amount data that includes the AC current value when the characteristic value of the inflection point derived by the inflection point derivation unit reaches the pre-specified value, and AC current is supplied to the charging unit while being increased from this AC current value, the current detection unit detects DC current values that flow to the image holding member in association with the AC current increases, and the update unit updates the AC current value of the supply amount data held by the holding unit when the characteristic value of the inflection point derived by the inflection point derivation unit reaches the pre-specified value.

11. The image forming device according to claim 1 wherein, in the case in which a DC voltage, while being increased, is supplied to the charging unit in the state in which the AC voltage value applied to the charging unit is maintained, the current detection unit detects the DC current values that flow to the image holding member in association with the DC voltage increases, and the inflection point derivation unit derives the inflection point of the correlation line representing the correlation between the DC current values that are detected by the current detection unit and the DC voltage values that are supplied to the image holding member at the times of detection of these DC current values.

12. The image forming device according to claim 11, wherein the holding unit holds supply amount data that includes the DC voltage value when the characteristic value of the inflection point derived by the inflection point derivation unit reaches the pre-specified value, and DC voltage is supplied to the charging unit while being increased from this DC voltage value, the current detection unit detects DC current values that flow to the image holding member in association with the DC voltage increases, and the update unit updates the DC voltage value of the supply amount data held by the holding unit when the characteristic value of the inflection point derived by the inflection point derivation unit reaches the pre-specified value.

13. A non-transitory computer readable medium storing a program causing a computer to execute a process for estimating a deterioration condition of a photoreceptor, the process comprising:

applying a voltage in which a DC voltage and an AC voltage are superimposed at a charging unit that charges a surface of an image holding member, which is provided with a photoreceptor at a surface thereof and holds an electrostatic image that is formed at the surface by light being illuminated in accordance with image information in a charged state, detecting DC current values that flow to the image holding member in association with supply amount increases for one of: a case in which an AC current, while being increased, is supplied to the charging unit in a state in which the DC voltage value and AC voltage value applied to the charging unit are maintained, or a case in which a DC voltage, while being increased, is supplied to the charging unit in a state in which the AC voltage value applied to the charging unit is maintained;

deriving an inflection point of a correlation line representing a correlation between the detected DC current values and the supply amounts that are supplied to the image holding member at times of the detecting of the DC current values;

executing pre-specified processing when a characteristic value of the derived inflection point reaches a pre-specified value;

holding supply amount data representing the supply amount when the derived characteristic value of the inflection point reaches the pre-specified value; and updating the held supply amount data when the characteristic value of the derived inflection point reaches the pre-specified value in a state in which the supply amount data is held.

14. The computer readable medium according to claim 13, wherein the executing comprises, when the characteristic value of the derived inflection point reaches one of a plurality of pre-specified values, executing processing in accordance with this pre-specified value.

15. The computer readable medium according to claim 13, wherein the characteristic value is a gradient of a tangent at the inflection point.

16. A photoreceptor deterioration condition estimation method comprising:

applying a voltage in which a DC voltage and an AC voltage are superimposed at a charging unit that charges a surface of an image holding member, which is provided with a photoreceptor at a surface thereof and holds an electrostatic image that is formed at the surface by light being illuminated in accordance with image information in a charged state, detecting DC current values that flow to the image holding member in association with supply amount increases for one of: a case in which an AC current, while being increased, is supplied to the charging unit in a state in which the DC voltage value and AC voltage value applied to the charging unit are maintained, or a case in which a DC voltage, while being increased, is supplied to the charging unit in a state in which the AC voltage value applied to the charging unit is maintained;

deriving an inflection point of a correlation line representing a correlation between the detected DC current values and the supply amounts that are supplied to the image holding member at times of the detecting of the DC current values;

executing pre-specified processing when a characteristic value of the derived inflection point reaches a pre-specified value;

holding supply amount data representing the supply amount when the derived characteristic value of the inflection point reaches the pre-specified value; and updating the held supply amount data when the characteristic value of the derived inflection point reaches the pre-specified value in a state in which the supply amount data is held.

* * * * *